US011527222B1

(12) United States Patent
Baldemor

(10) Patent No.: US 11,527,222 B1
(45) Date of Patent: Dec. 13, 2022

(54) DEVICES FOR ALTERING SOUNDS PRODUCED BY STRING INSTRUMENTS

(71) Applicant: Jay Baldemor, Yorba Linda, CA (US)

(72) Inventor: Jay Baldemor, Yorba Linda, CA (US)

( * ) Notice: Subject to any disclaimer, the term of this patent is extended or adjusted under 35 U.S.C. 154(b) by 0 days.

(21) Appl. No.: 17/549,635

(22) Filed: Dec. 13, 2021

(51) Int. Cl.
*G10D 3/00* (2020.01)
*G10G 7/02* (2006.01)

(52) U.S. Cl.
CPC ..... *G10D 3/00* (2013.01); *G10G 7/02* (2013.01)

(58) Field of Classification Search
CPC ..... G10D 3/00; G10G 7/02
See application file for complete search history.

(56) References Cited

U.S. PATENT DOCUMENTS

2010/0083810 A1* 4/2010 Tran ..... G10D 3/173 84/322

* cited by examiner

*Primary Examiner* — Kimberly R Lockett

(57) ABSTRACT

A device for altering the musical sounds produced by string instruments is disclosed. The device is adapted to be reversibly wrapped around and attached to a set of strings of a string instrument. The device includes a top portion and a bottom portion; an exterior surface and an interior surface; a sound altering material located on the interior surface at a location that is configured to make contact with the set of strings when the device is attached to a string instrument; one or more compartments located on the exterior surface that are configured to receive and hold a pick; and an aperture located on the exterior surface that is configured to receive and hold a string instrument tuner.

10 Claims, 9 Drawing Sheets

DEVICES FOR ALTERING SOUNDS PRODUCED BY STRING INSTRUMENTS

FIELD OF THE INVENTION

The field of the invention relates to accessories and devices for musical instruments. More particularly, the field of the present invention relates to accessories and devices that may be used to alter the musical sounds produced by string instruments.

BACKGROUND OF THE INVENTION

String instruments are musical instruments that generate sound from one or more vibrating strings. In many instruments, the vibrations of such strings are transmitted to the body of the instrument, which also vibrates (along with the air inside of the instrument) to produce a musical sound (or, in the case of electrically amplified instruments, devices are employed that electronically harvest and transmit the sounds generated by vibrating strings). The strings of such musical instruments can be vibrated in a number of ways, such as through plucking, bowing, and/or striking the strings of the instrument.

There are various ways to adjust the pitch of a vibrating string. For example, many string instruments may be tuned by adjusting the tension of the strings, or using controls that are present on the instrument to increase or reduce the tension of the strings, which thereby affects the pitch created by the strings. In addition, some instruments will include a fingerboard, which allows a musician to apply pressure to one or more strings (against the fingerboard), which alters the length and tension properties of the strings (which also affects the pitch created by the strings).

Although existing methods exist to adjust the pitch of vibrating strings in such instruments, there is a continuing demand for new and improved devices that can be used to modulate the pitch generated by the vibrating strings, in order to alter the musical sounds produced by string instruments. In addition, it would be advantageous for such improved devices to offer further benefits, such as means for holding instrument accessories (such as guitar picks) and/or means that facilitate tuning of such instruments. As the following will demonstrate, the devices and methods of the present invention address such demands in the marketplace (along with others).

SUMMARY OF THE INVENTION

According to certain aspects of the invention, a device for altering the musical sounds produced by string instruments is provided. The device is adapted to be wrapped around and attached to a set of strings of a string instrument (and then removed from the instrument as desired). The device generally includes an exterior surface; an interior surface; a top portion; and a bottom portion, with the bottom portion being configured to be connected to, and disconnected from, the exterior surface of the device. The interior surface of the device further includes a sound altering material positioned at a location that is configured to make contact with the set of strings when the device is attached to the string instrument.

According to certain preferred aspects of the invention, the device further includes one or more compartments located on the exterior surface that are configured to receive and hold a pick. In addition, the device preferably includes an aperture located on the exterior surface that is configured to receive and hold a string instrument tuner. The invention provides that the device is configured to be attached to the set of strings by wrapping the device around the set of strings and connecting the bottom portion of the device to the exterior surface of the device, such that the sound altering material contacts and is held adjacent to the set of strings.

The invention provides that the sound altering material may consist of a plurality of small plastic loops attached to the interior surface. In other embodiments, the material may be comprised of other plastic materials, a fabric, an elastomer, wood, metals, a polymeric material, or a combination thereof (depending on the string vibration effects that are desirable). In certain embodiments, the sound altering materials may be interchangeable, such that a first sound altering material may be removed from the interior surface of the device and replaced with a second/alternative sound altering material.

In addition to the device described herein, the invention further encompasses a combination of the device and a string instrument. Still further, the invention encompasses a combination of the device and one or more picks, a tuner, or a combination of such items.

The above-mentioned and additional features of the present invention are further illustrated in the Detailed Description contained herein.

DETAILED DESCRIPTION OF THE INVENTION

Figure 1:
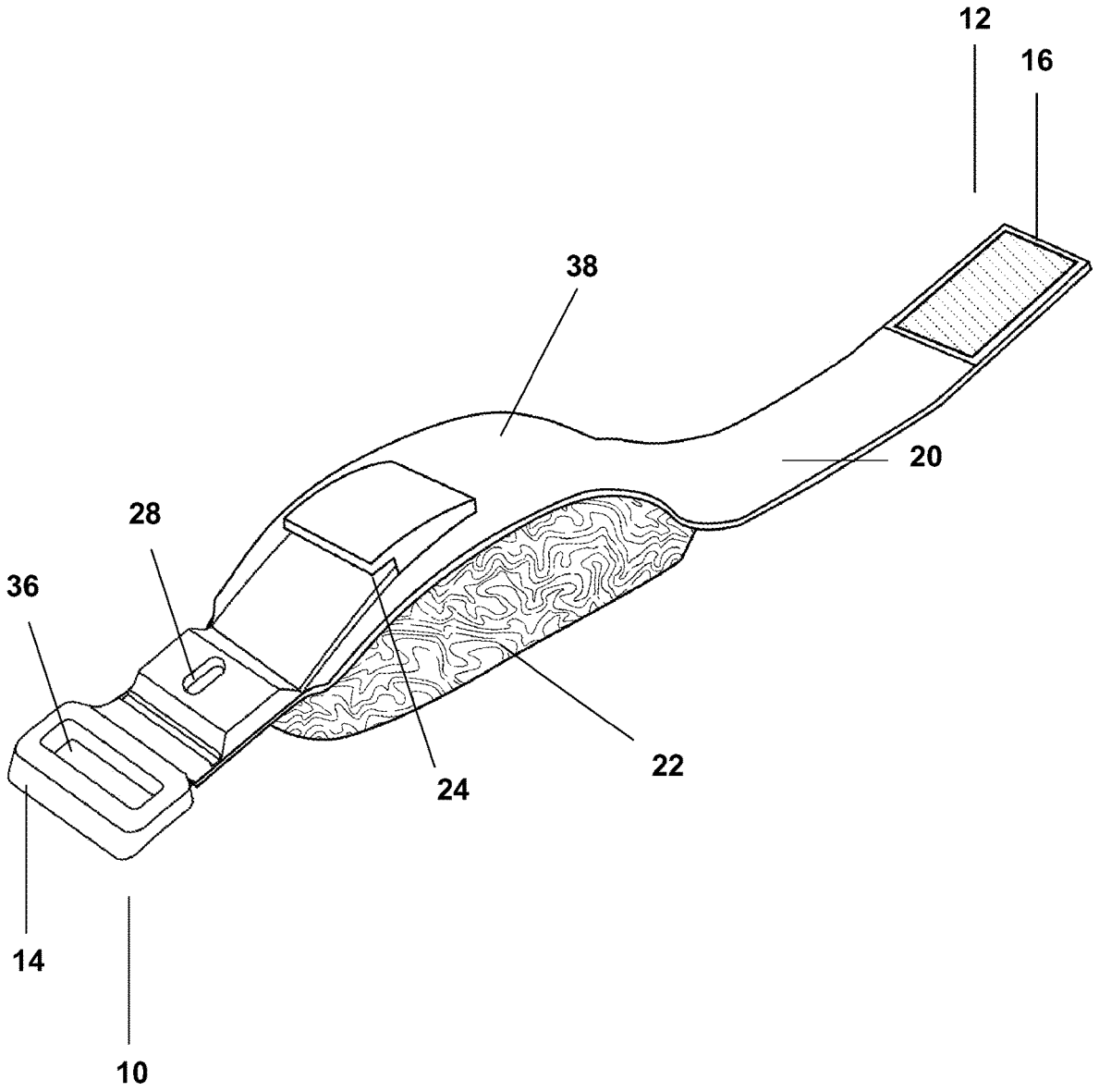
FIG. 1 is a top perspective view of the device of the present invention.
Figure 2:
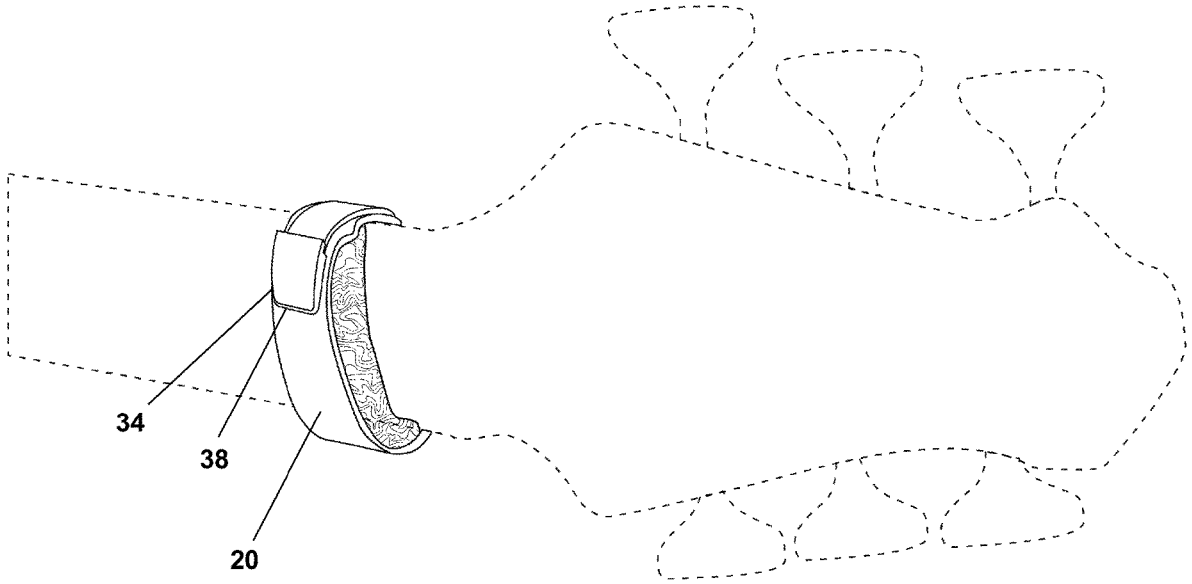
FIG. 2 is a view of the device of the present invention attached to a nut side/headstock side of a set of strings of a string instrument.

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used, and made without departing from the scope and spirit of the invention.

Referring now to FIGS. 1-12, according to certain preferred embodiments of the present invention, devices for altering the musical sounds produced by string instruments are provided. In certain embodiments, the devices are adapted to be attached to a set of strings of a string instrument, such as a guitar (as illustrated in FIGS. 2-6), and then removed from the instrument as desired. A device of the present invention generally includes a top portion 10 and a bottom portion 12, which includes a first end 14 and a second end 16 of the device. The invention provides that the device further includes an interior surface 18 and an exterior surface 20. The interior surface 18, or a portion thereof, includes a sound altering material 22 (described below). More specifically, the invention provides that the device will preferably be configured such that when the device is wrapped around and applied to a set of strings as described and illustrated herein, the sound altering material 22 will cover all of the strings of the instrument. The terms interior surface 18 and exterior surface 20, as used herein, are in relation to the configuration of the device when it is wrapped around and applied to a set of strings, insofar as the interior surface 18 is located on the inside of the doughnut-shaped object that the device forms and the exterior surface 20 is located on the outside surface thereof (See, e.g., FIG. 2).

According to certain embodiments of the invention, the device will preferably be adapted to be applied to a nut side/headstock side of the set of strings of the string instrument, as illustrated in FIGS. 2-6. More specifically, the device is configured to be attached to the set of strings by wrapping the device around the set of strings and connecting the bottom portion 12 of the device to the exterior surface 20 of the device. Such configuration enables the sound altering material 22 to contact and be held adjacent to the set of strings.

According to certain preferred embodiments, the invention provides that the bottom portion 12 of the device (and a corresponding area of the exterior surface 20) may comprise a set of loop-and-hook materials (e.g., the type of material used to form loop-and-hook attachment means, commonly referred to as Velcro®) to reversibly connect the bottom portion 12 of the device to a dedicated area on the exterior surface 20 of the device. More specifically, for example, the interior surface 18 at the bottom portion 12 (at or near the second end 16) may include a first loop-and-hook material 34 (FIG. 8), e.g., a hook-type of material. When the device is applied to the string instrument and wrapped around the set of strings, the bottom portion 12 may be inserted through a rectangular aperture 36 (which forms a portion of a buckle) located at the first end 14, such that the bottom portion 12 may then be placed adjacent to, and thereby adjoined to, a dedicated area 38 on the exterior surface 20 of the device via a complementary material (e.g., a loop-type of material)(See FIG. 2). In other embodiments, the device may include other mechanical means to connect the bottom portion 12 of the device to the exterior surface 20 of the device, such as snaps, buckles, magnets, latches, buttons, and combinations of such means.

The invention provides that the sound altering material 22 may consist of a plurality of small plastic loops attached to the interior surface 18 (e.g., the type of material used to form hook-and-loop attachment means, commonly referred to as Velcro®). In other embodiments, the sound altering material 22 may consist of other plastic materials, a fabric, an elastomer, wood, metals, a polymeric material, or a combination thereof (depending on the string vibration effects that are sought). In certain embodiments, the sound altering materials 22 may be interchangeable, such that a first sound altering material 22 may be removed from the interior surface 18 and replaced with a second/alternative type of sound altering material 22. The other portions of the device, i.e., other than the sound altering material 22, may be comprised of plastic materials, fabrics, elastomers, polymeric materials, or combinations thereof.

Figure 3:
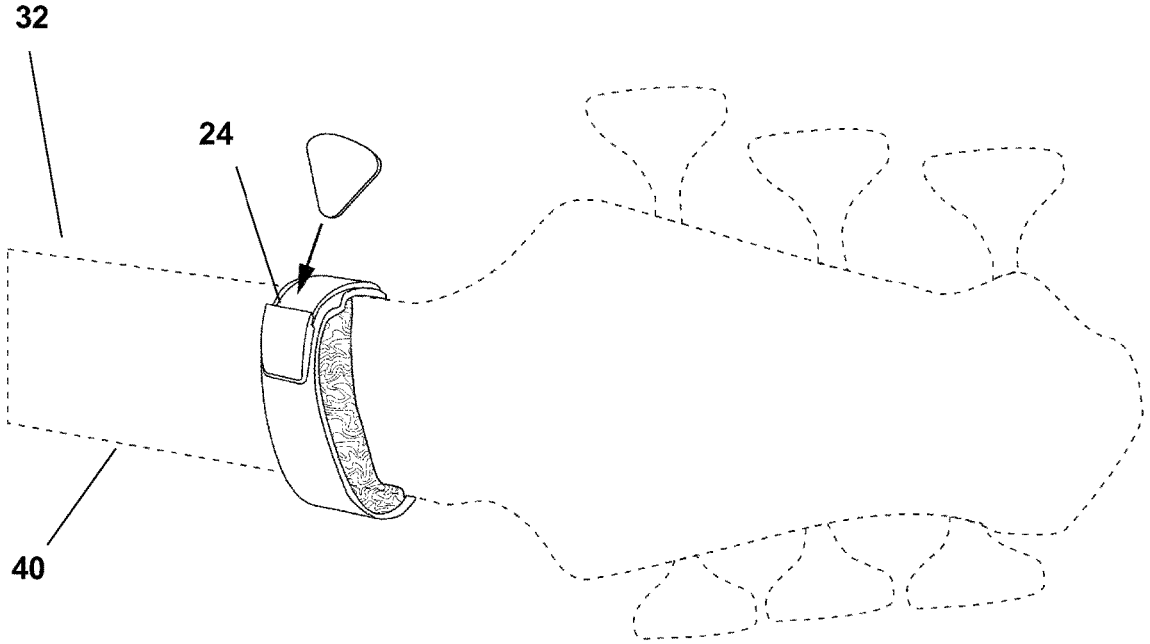
FIG. 3 is a view of the device of the present invention attached to a nut side/headstock side of a set of strings of a string instrument, showing a pick accessory being inserted into the one or more slits described herein.
Figure 4:
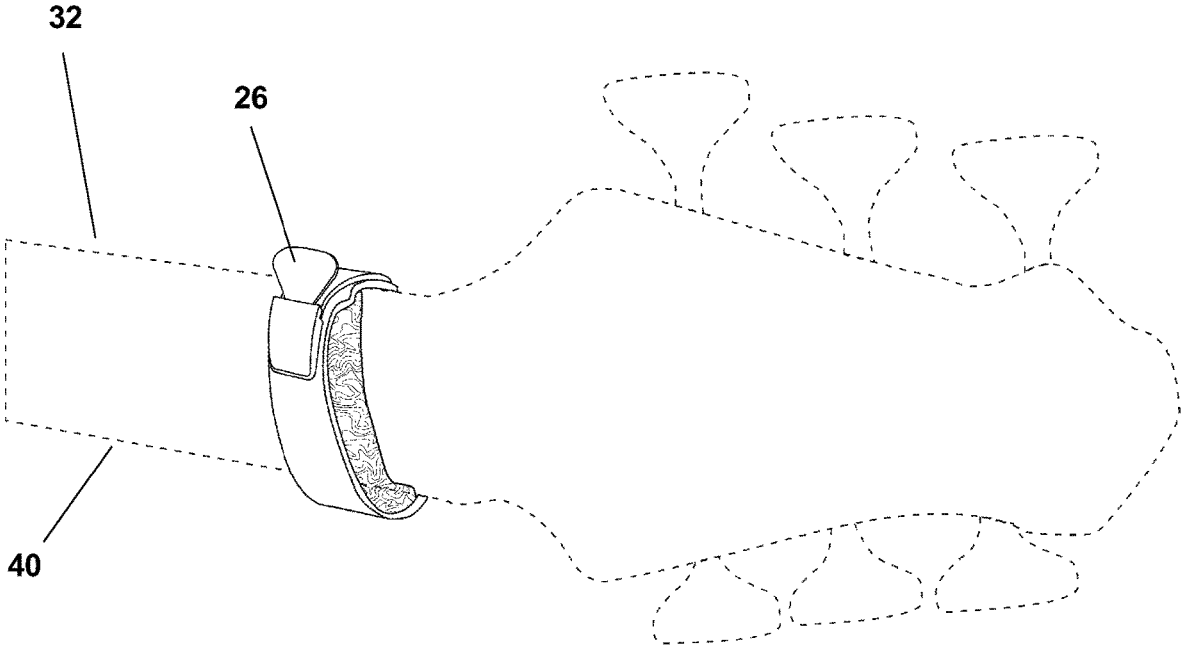
FIG. 4 is another view of the device of the present invention attached to a nut side/headstock side of a set of strings of a string instrument, showing a pick accessory inserted into the one or more slits described herein.
Figure 5:
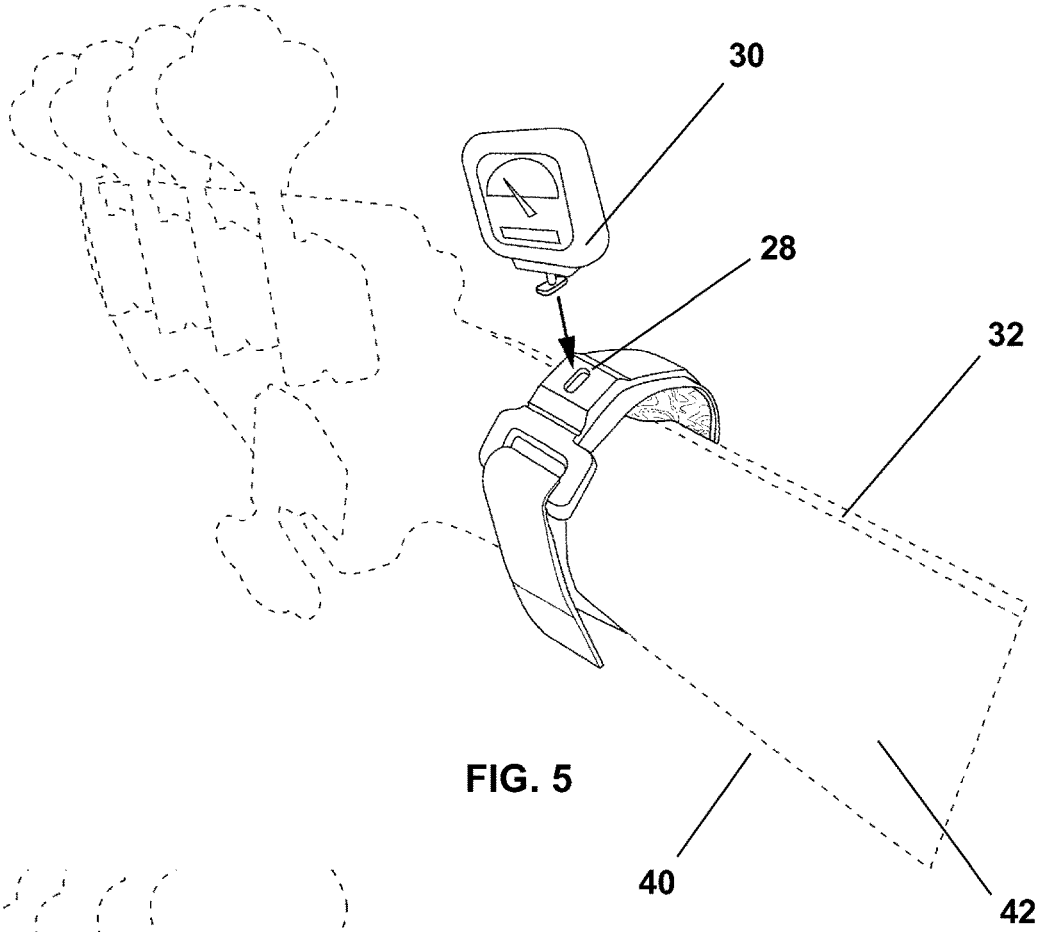
FIG. 5 is a view of the device of the present invention attached to a nut side/headstock side of a set of strings of a string instrument, showing a tuner being inserted into the aperture described herein.

According to certain preferred embodiments of the present invention, the device further includes one or more compartments 24, such as 1, 2, 3, 4, or more compartments 24, located on the exterior surface 20 that are configured to receive and nestably hold a pick 26 (or multiple picks 26)(FIGS. 3 and 4). The invention provides that such compartments 24 will preferably include an interior dimension that allows a pick 26 to nestably be inserted into and retained within the compartments 24.

Figure 6:
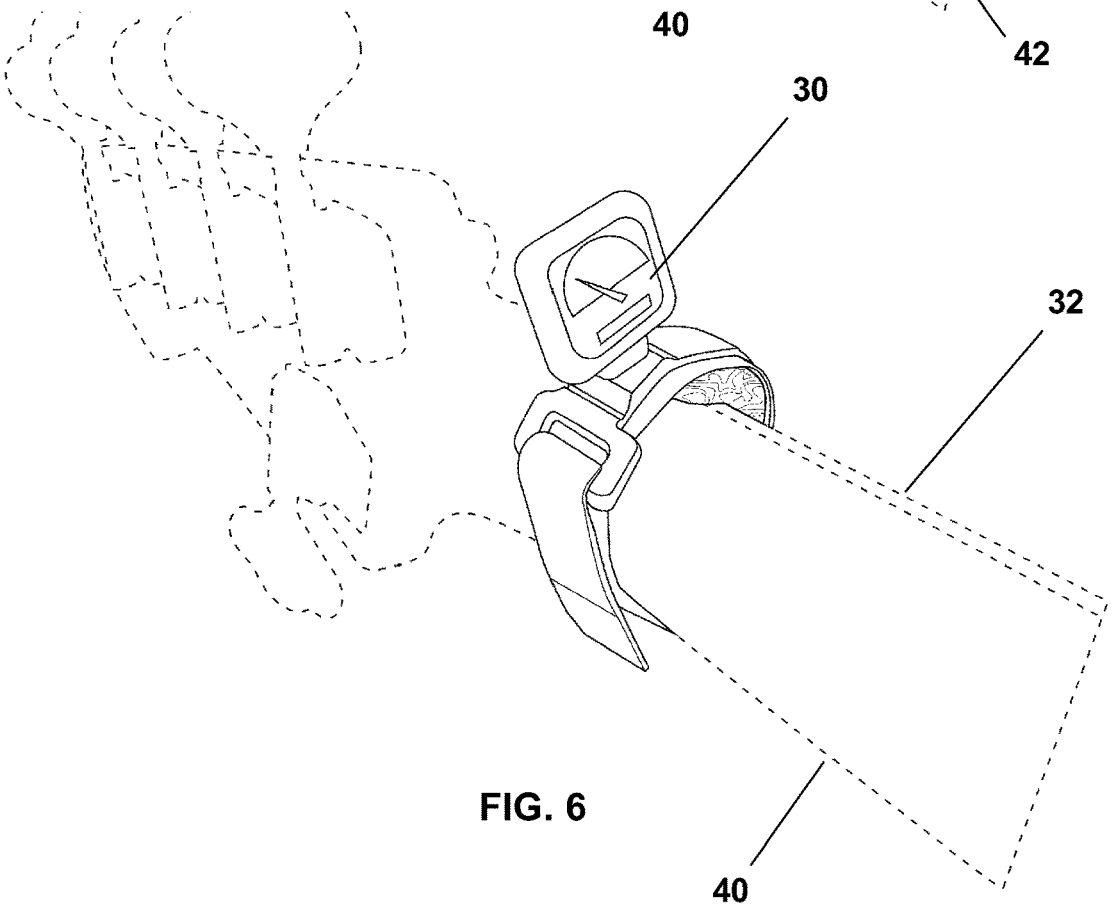
FIG. 6 is another view of the device of the present invention attached to a nut side/headstock side of a set of strings of a string instrument, showing a tuner inserted into the aperture described herein.
Figure 7:
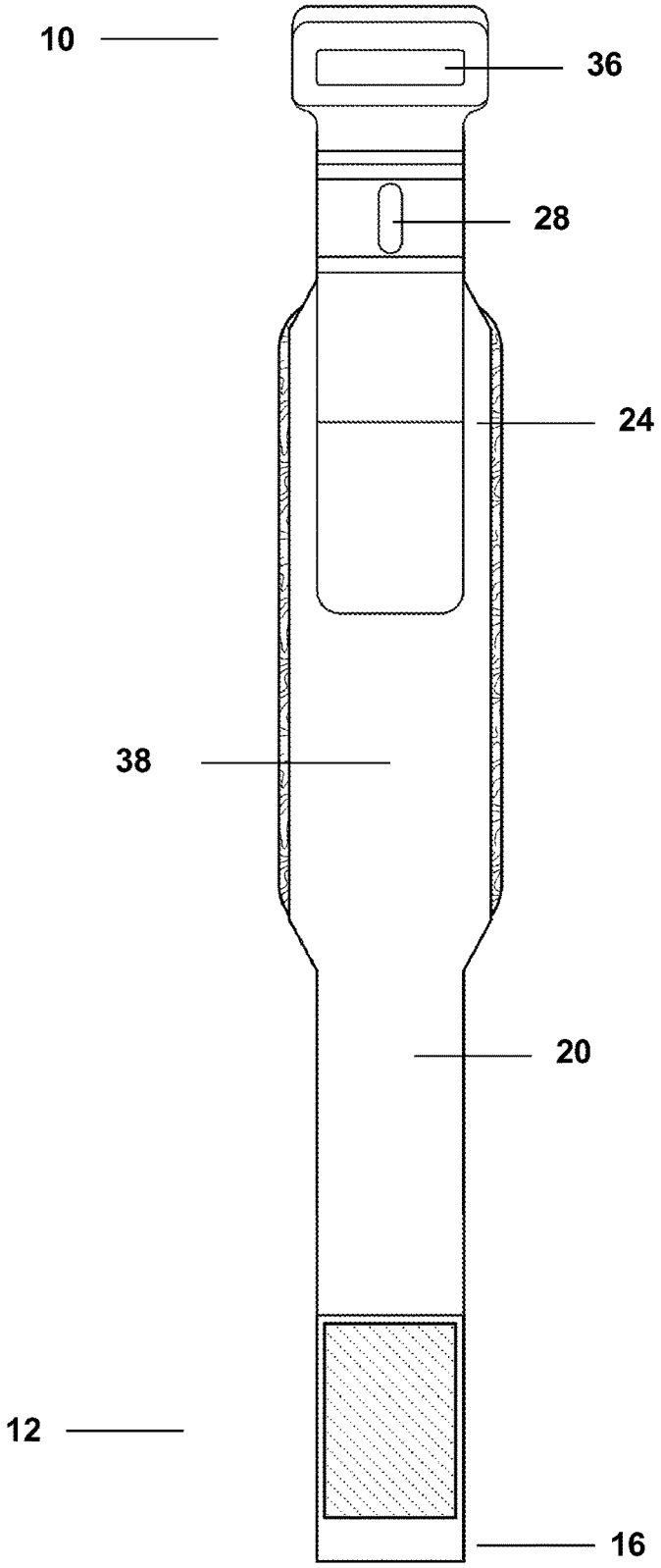
FIG. 7 is a front side view of the device of the present invention, showing the exterior surface of the device.
Figure 8:
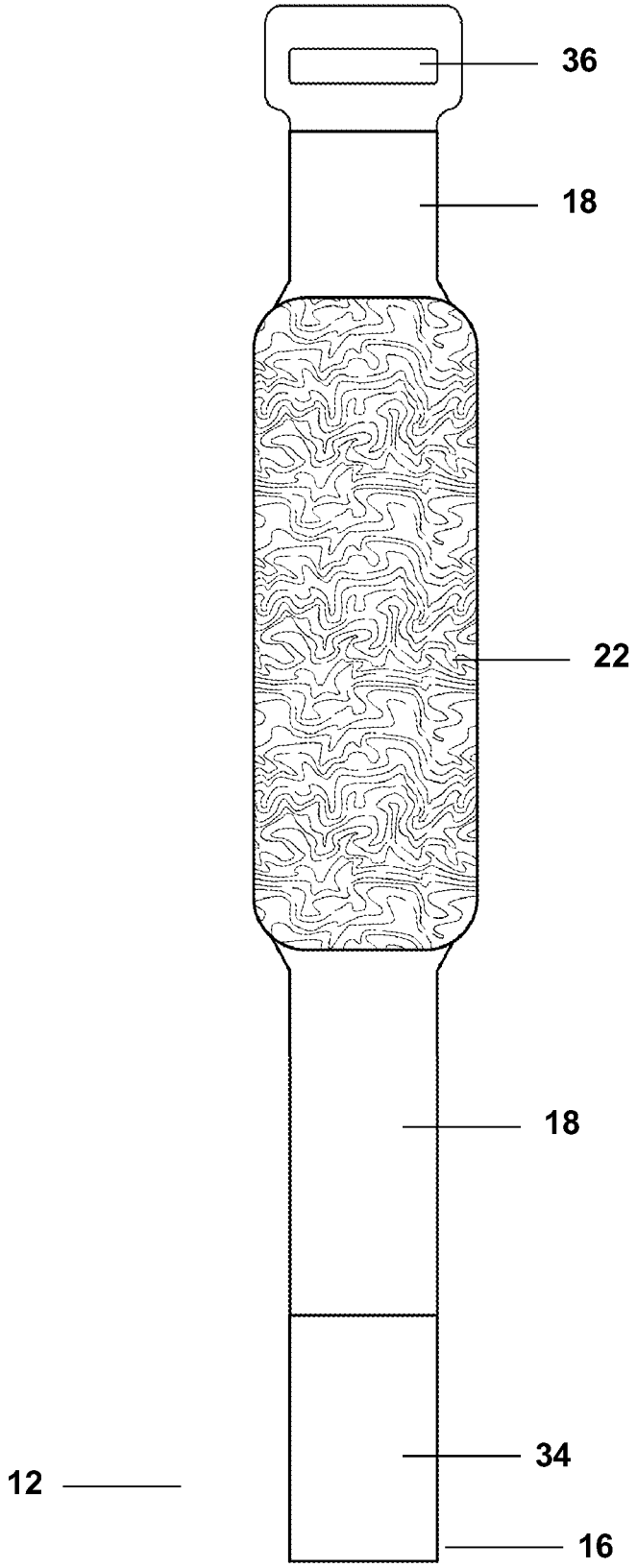
FIG. 8 is a back side view of the device of the present invention, showing the interior surface and sound altering material of the device.
Figure 9:
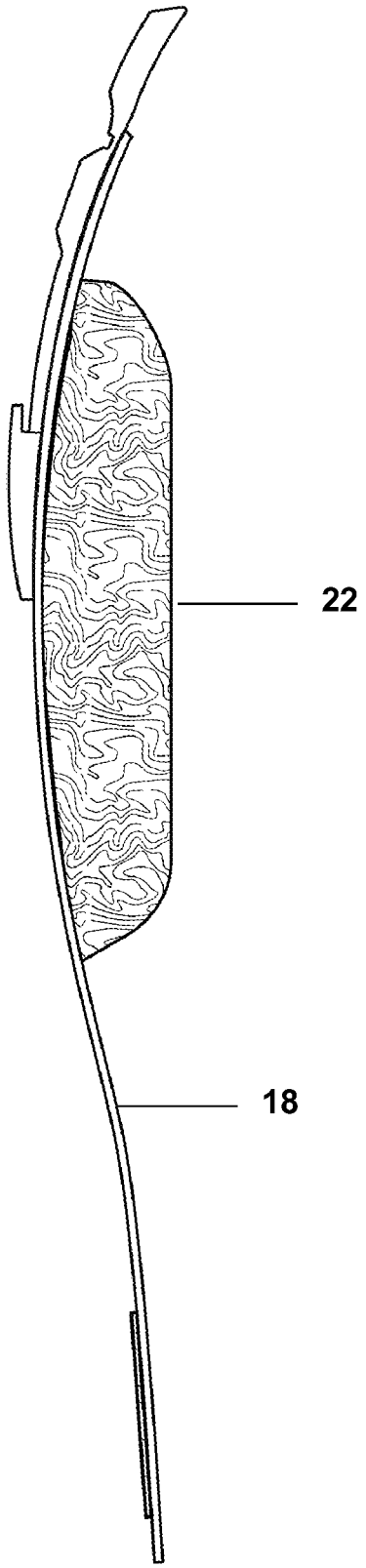
FIG. 9 is a left side view of the device of the present invention.
Figure 10:
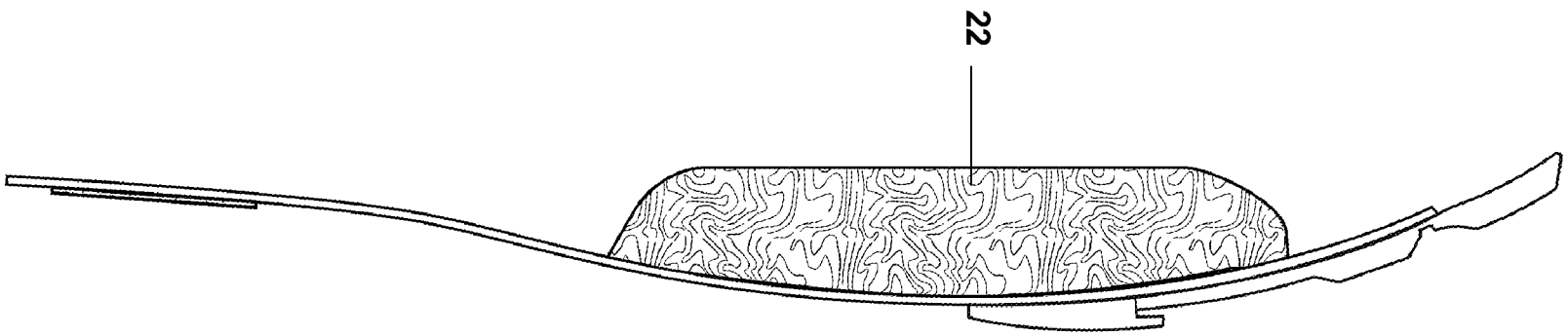
FIG. 10 is a right side view of the device of the present invention.
Figure 11:
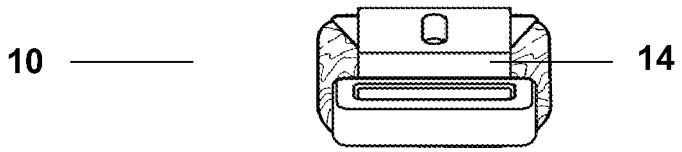
FIG. 11 is a top view of the device of the present invention.
Figure 12:
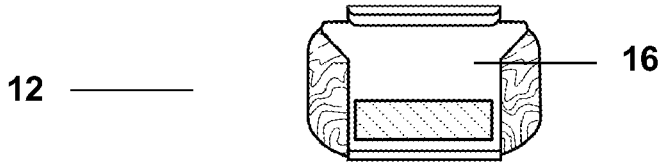
FIG. 12 is a bottom view of the device of the present invention.

In addition, according to such preferred embodiments, the device further includes an aperture 28 located on the exterior surface 20 that is configured to receive and hold a string instrument tuner 30. In certain embodiments, the tuner 30 may include a foot element, which exhibits a size and dimension that can be inserted into the aperture 28 in a certain first orientation and then rotated about 45-degrees to a second orientation to temporarily affix the tuner 30 to the aperture 28 of the device (such that, upon rotating the tuner 30 about 45-degrees, the tuner 30 can remain affixed to the device and is facing a person who is holding the instrument and is using the tuner 30)(FIG. 6). According to other embodiments, the invention provides that the tuner 30 may be reversibly affixed to the device through other means, such as snaps, buckles, magnets, latches, buttons, and combinations of such means. The invention provides that the tuner 30 may be configured to detect and report the tune of strings based on sound (via a microphone); by detecting and reporting string vibrations; or a combination of such methods. The invention provides that the one or more compartments 24 and the aperture 28 are preferably located adjacent to a top side 32 of the string instrument when the device is attached to a nut side/headstock side of the set of strings of the string instrument (FIGS. 3-6), as opposed to the bottom side 40, front side (not shown), or back side 42 of the string instrument.

In addition to the device described herein, the invention further encompasses a combination of the device and a string instrument, e.g., a string instrument (e.g., guitar) packaged and offered for sale along with the device. In addition to the device described herein, the invention further encompasses a combination of the device and one or more picks 26, a tuner 30, or a combination of such items.

The many aspects and benefits of the invention are apparent from the detailed description, and thus, it is intended for the following claims to cover all such aspects and benefits of the invention that fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A device that is adapted to be attached to a set of strings of a string instrument, which comprises:

(a) an exterior surface and an interior surface;

(b) a top portion and a bottom portion, wherein the bottom portion is configured to be connected to, and disconnected from, the exterior surface of the device;

(c) a sound altering material located on the interior surface at a location that is configured to make contact with the set of strings when the device is attached to the string instrument;

(d) one or more compartments located on the exterior surface that are configured to receive and hold a pick; and (e) an aperture located on the exterior surface that is configured to receive and hold a string instrument tuner, wherein the device is configured to be attached to the set of strings by wrapping the device around the set of strings and connecting the bottom portion of the device to the exterior surface of the device, such that the sound altering material contacts and is held adjacent to the set of strings.

2. The device of claim 1, wherein the device is adapted to be applied to a headstock side of the set of strings of the string instrument.

3. The device of claim 1, wherein the sound altering material comprises a plurality of loops attached to the interior surface, wherein the loops are comprised of a plastic material.

4. The device of claim 1, wherein the sound altering material comprises a plastic material, a fabric, an elastomer, wood, metals, a polymeric material, or a combination thereof.

5. The device of claim 1, wherein the sound altering material may be removed from the interior surface and replaced with an alternative sound altering material.

6. The device of claim 1, which further comprises a set of loop-and-hook materials to connect the bottom portion of the device to the exterior surface of the device.

7. The device of claim 1, which further comprises a mechanical means to connect the bottom portion of the device to the exterior surface of the device, wherein the mechanical means is selected from the group consisting of snaps, buckles, magnets, latches, buttons, and combinations of such means.

8. The device of claim 1, wherein the one or more compartments and the aperture are located on the exterior surface adjacent to each other.

9. The device of claim 8, wherein the one or more compartments and the aperture are located adjacent to a top side of the string instrument when the device is attached to a headstock side of the set of strings of the string instrument.

10. A device that is adapted to be attached to a set of strings of a string instrument, which comprises:

(a) an exterior surface and an interior surface;

(b) a top portion and a bottom portion, wherein the bottom portion is configured to be connected to, and disconnected from, the exterior surface through a set of loop-and-hook materials;

(c) a sound altering material located on the interior surface at a location that is configured to make contact with the set of strings when the device is attached to the string instrument;

(d) one or more compartments located on the exterior surface that are configured to receive and hold a pick; and (e) an aperture located on the exterior surface that is configured to receive and hold a string instrument tuner, wherein the device is configured to be attached to the set of strings by wrapping the device around the set of strings and connecting the bottom portion of the device to the exterior surface of the device, such that the sound altering material contacts and is held adjacent to the set of strings, and wherein (i) the one or more compartments and the aperture are located on the exterior surface adjacent to each other and (ii) the one or more compartments and the aperture are located adjacent to a top side of the string instrument when the device is attached to a headstock side of the set of strings of the string instrument.

* * * * *